United States Patent [19]

Barone

[11] Patent Number: 5,000,401

[45] Date of Patent: Mar. 19, 1991

[54] KITE

[76] Inventor: Salvatore Barone, 138 W. 15th, New York, N.Y. 10011

[21] Appl. No.: 412,942

[22] Filed: Sep. 26, 1989

[51] Int. Cl.[5] ..... B64C 31/06

[52] U.S. Cl. ..... 244/153 R; D21/88; 446/30

[58] Field of Search ..... 244/153 R–155 A; D21/87–90, 84; 446/34, 487, 488, 30–33

[56] References Cited

U.S. PATENT DOCUMENTS

| | | | |
|---|---|---|---|
| D. 246,737 | 12/1977 | Barrett et al. | D21/88 |
| D. 285,324 | 8/1986 | Barker | D21/89 |
| 2,208,786 | 7/1940 | Astle | 244/153 R |
| 2,461,465 | 2/1949 | Chu et al. | 244/153 R |
| 4,119,283 | 10/1978 | DeYarman | 244/153 R |
| 4,354,647 | 10/1982 | Carpenter | 244/153 R |

FOREIGN PATENT DOCUMENTS

| | | | |
|---|---|---|---|
| 1247663 | 9/1971 | United Kingdom | 244/153 R |

*Primary Examiner*—Galen Barefoot

*Attorney, Agent, or Firm*—MacMillan, Sobanski & Todd

[57] ABSTRACT

A kite includes a flat body portion which is formed from a thin sheet of a rigid lightweight material, such as styrofoam or balsa. The body portion may be formed in any desired shape which is symmetric about a vertical axis, such as a heart or a star. A slot is formed through the body portion and extends along a portion of such vertical axis. The slot is provided to releasably attach a forwardly extending keel portion to the body portion. The keel portion is formed from the same rigid lightweight material as the body portion. The keel portion includes a tab which is inserted through the slot to attach the keel portion to the body portion to form the kite. The keel portion further includes an aperture through which a string may be tied to the kite. One or more smaller slots may be formed through a lower region of the body portion to permit a tail to be secured to the kite.

10 Claims, 1 Drawing Sheet

KITE

BACKGROUND OF THE INVENTION

This invention relates in general to kite structures and in particular to an improved kite formed from a rigid lightweight material.

Kites are well known and popular flying toys, and many varied kite structures have been developed over the years. Often, kites are formed from a lightweight flexible material, such as paper or sheet plastic, which is mounted on a relatively rigid frame. A tail is usually attached to the lower end of the kite for stabilization purposes. A string is attached to an upper or central portion of the kite. When the kite is held up in a breeze, the force exerted by the wind pushes the kite upwardly into the air in a well known manner.

SUMMARY OF THE INVENTION

This invention relates to an improved structure for a kite. The kite includes a flat body portion which is formed from a thin sheet of a rigid lightweight material, such as styrofoam or balsa. The body portion may be formed in any desired shape which is symmetric about an axis, such as a heart or a star. A slot is formed through the body portion and extends along a portion of such axis. The slot is provided to releasably attach a forwardly extending keel portion to the body portion. The keel portion is formed from the same rigid lightweight material as the body portion. The keel portion includes a tab which is inserted through the slot to attach the keel portion to the body portion and thereby form the kite. The keel portion further includes an aperture through which a string may be tied to the kite. One or more smaller slots may be formed through a lower region of the body portion to permit a tail to be secured to the kite.

It is an object of this invention to provide an improved structure for a kite formed from a rigid lightweight material.

It is another object of this invention to provide such an improved kite structure which is simple and inexpensive in construction.

Other objects and advantages of this invention will become apparent to those skilled in the art from the following detailed description of the preferred embodiments, which read in light of the accompanying drawings.

DETAILED DESCRIPTION OF THE PREFERRED EMBODIMENTS

Figure 1:
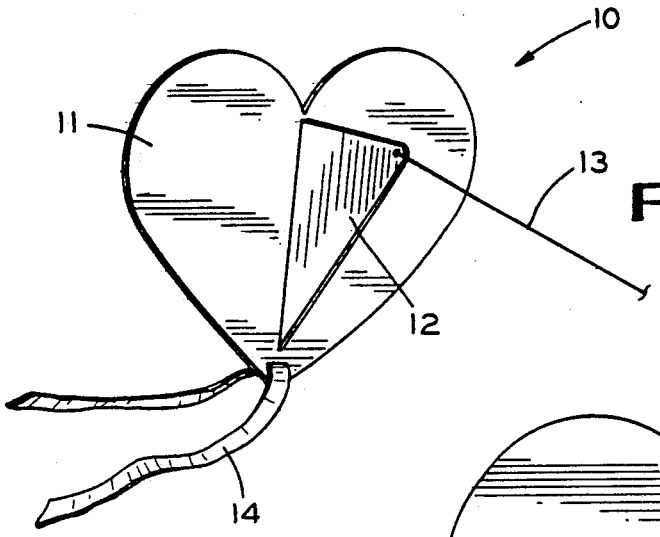
FIG. 1 is a perspective view of a kite in accordance with this invention.
Figure 2:
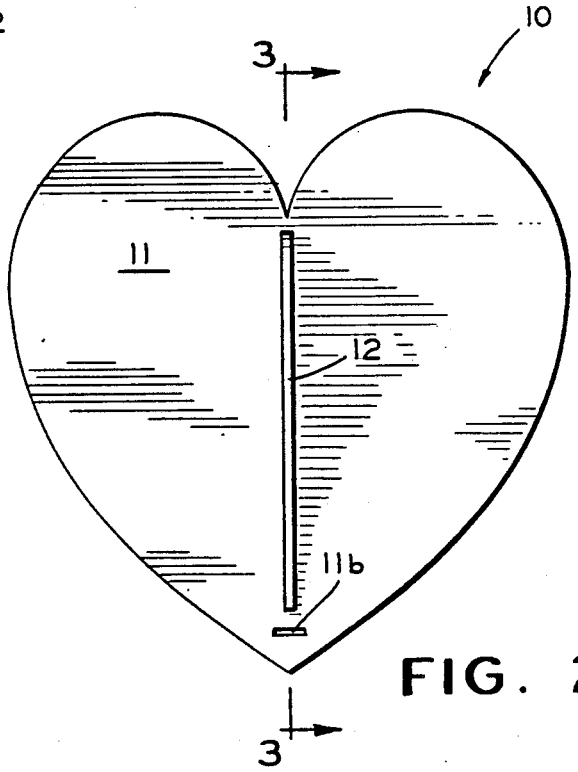
FIG. 2 is a front elevational view of the kite illustrated in FIG. 1, the tail of the kite being removed for clarity.
Figure 3:
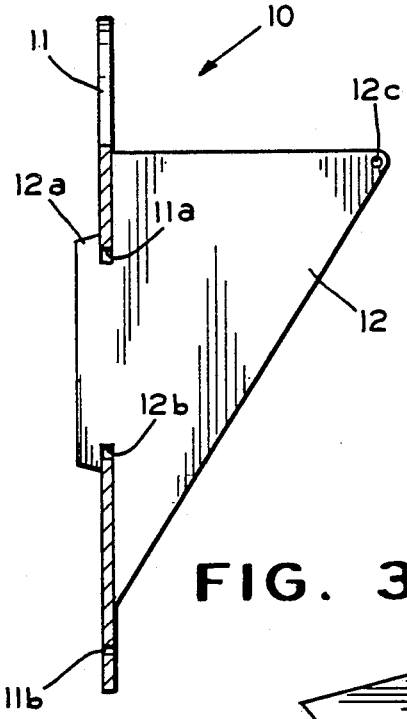
FIG. 3 is a sectional elevational view of the kite taken along line 3—3 of FIG. 2.

Referring now to the drawings, there is illustrated in FIGS. 1 through 3 a kite, illustrated generally at 10, in accordance with this invention. The kite 10 includes a body portion 11 and a keel portion 12, both of which are preferably flat and formed from a rigid lightweight material, such as styrofoam or balsa. The thicknesses of the body portion 11 and the keel portion 12 may vary with the specific material which is used, but it has been found that styrofoam having a thickness in the range of from 0.060 inch to 0.100 inch will operate satisfactorily.

Figure 4:
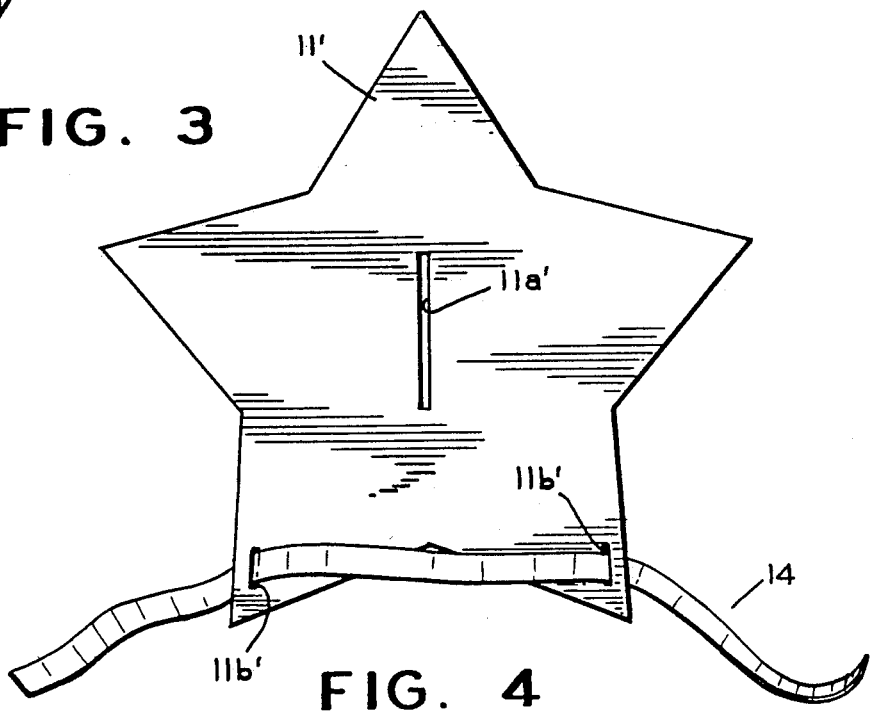
FIG. 4 is a front elevational view, similar to FIG. 2, of an alternate embodiment of the kite.

The body portion 11 of the kite 10 is formed having a shape which is symmetric about an axis. For example, as shown in FIG. 2, the body portion 11 can be formed in the shape of a heart, which defines a central vertical axis dividing the heart shaped body portion 11 into two mirror image halves. Alternatively, as shown in FIG. 4, the body portion 11' may be formed in the shape of a star. In either event, a slot 11*a* (FIG. 3) or 11*a'*. (FIG. 4) is formed through the body portion 11 or 11'. The slots 11*a* and 11*a'* extend a predetermined length along the central vertical axes defined by the body portions 11 and 11', respectively. Other similar shapes for the body portion 11 of the kite are contemplated to be within the scope of this invention.

The keel portion 12 of the kite 10 is formed having the general shape of a right triangle and is provided with a tab 12*a*. As best shown in FIG. 3, the tab 12*a* is formed integrally with the keel portion 12 through a neck 12*b*. The tab 12*a* has a length which is slightly longer than the length of the slot 11*a*, while the neck 12*b* has a length which is somewhat shorter than the length of the slot 11*a*. The keel portion 12 is also provided with an aperture 12*c* near the upper and outer edge thereof. The aperture 12*c* permits a string 13 to be easily tied thereto, as shown in FIG. 1. As described below, the tab 12*a* cooperates with the slots 11*a* or 11*a'* to attach the keel portion 12 to the body portions 11 or 11'.

To attach the keel portion 12 to the body portion 11, the upper edge of the tab 12*a* is initially inserted through the slot 11*a* and moved upwardly relative to the body portion 11 until the neck 12*b* of the keel portion 12 abuts the upper end of the slot 11*a*. Depending upon the specific sizes of the slot 11*a* and the tab 12*a*, it may be necessary to slightly flex the body portion 11 to permit passage of the tab 12*a* through the slot 11*a*. Next, the lower end of the keel portion 12 is pivoted toward the body portion 11 such that the lower edge of the tab 12*a* passes through the slot 11*a*. Once the lower edge of the tab 12*a* has passed through the slot 11*a*, the keel 12 is moved downwardly relative to the body portion 11 such that the both the upper and lower edges of the tab 12*a* engage the back side of the body portion 11. In this position, the neck 12*b* of the keel portion 12 is spaced apart from both the upper and lower ends of the slot 11*a* formed through the body portion.

Preferably, the width of the slot 11*a* is approximately equal to the thickness of the keel portion 12, and the length of the neck 12*b* of the keel portion 12 is approximately equal to the thickness of the body portion 11. Such sizing will cause a light frictional engagement between the body portion 11 and the keel portion 12 when assembled as described above. Consequently, the keel portion 12 is prevented from becoming accidently separated from the body portion 11. To remove the keel portion 12 from the body portion 11, the above described procedure is reversed.

A second slot 11*b* is formed through the body portion 11 of the kite 10. As best shown in FIGS. 2 and 3, the second slot 11*b* is formed near the lower end of the body portion 11. The second slot 11*b* extends transverse to the first slot 11*a* and bisects the central vertical axis discussed above. The second slot 11*b* is provided to permit a tail 14 to be attached to the body portion 11. In the illustrated embodiment, the tail 14 may be a length of ribbon which is fed through the second slot 11*b*. The ribbon 14 is positioned such that the midpoint thereof is disposed within the slot 11*b*. In this position, it has been found that the ribbon 14 will remain in the slot 11*b* and not become dislodged during use. However, it may be desirable to use a ribbon 14 having a width which is slightly larger than the length of the second slot 11*b* such that a slight frictional engagement is maintained between the body portion 11 and the ribbon 14. As is well known, the tail 14 provides stabilization when the kite 10 is flown.

The alternate embodiment illustrated in FIG. 4 has second and third slots 11*b*′ formed through the body portion 11′ for receiving the tail 14. In this embodiment, the second and third slots 11*b*′ are located equidistantly from the central vertical axis through the body portion 11′. Also, the second and third slots 11*b*′ extend parallel to the first slot 11*a*′. As with the second slot 11*b* discussed above, it is preferable that the second and third slots 11*b*′ be located near the lower end of the body portion 11′ for stabilization purposes.

In accordance with the provisions of the patent statutes, the principle and mode of operation of this invention have been explained and illustrated in its preferred embodiments. However, it must be understood that this invention may be practiced otherwise than as specifically explained and illustrated without departing from its spirit or scope.

What is claimed is:

1. A kite comprising:

a body portion formed from a rigid lightweight material, said body portion having a front face, a rear face, and a slot having a predetermined length formed completely within said body portion; and a keel portion formed from a rigid lightweight material, said keel portion including a tab connected by a neck to said keel portion, said neck having a length which is less than said predetermined length, said tab having a length which is greater than said predetermined length so as to define first and second edges, said neck being disposed in said slot such that said keel portion engages said front face of said body portion and said edges of said tab engage said rear face of body portion to attach said keel portion being attached to said body portion and extending perpendicularly forwardly therefrom.

2. The invention defined in claim 1 wherein said body portion has a slot formed therethrough and said keel portion has a tab formed thereon, said tab cooperating with said slot to attach said keel portion to said body portion.

3. The invention defined in claim 2 wherein said slot has a predetermined length and said tab has a length which is greater than said predetermined length.

4. The invention defined in claim 3 wherein said tab is formed integrally with said keel portion through a neck, said neck having a length which is less than said predetermined length.

5. The invention defined in claim 2 wherein said slot extends along an axis which divides said body portion into two mirror image halves.

6. The invention defined in claim 1 further including means for attaching a tail to said body portion.

7. The invention defined in claim 6 wherein said means for attaching includes a slot formed through said body portion.

8. The invention defined in claim 6 wherein said means for attaching includes a pair of slots formed through said body portion, said slots being located equidistantly from and on opposite sides of an axis which divides said body portion into two mirror image halves.

9. The invention defined in claim 1 wherein said body portion is formed in the shape of a heart.

10. The invention defined in claim 1 wherein said body portion is formed in the shape of a star.

* * * * *